US006890881B2

(12) United States Patent
Tsukada

(10) Patent No.: US 6,890,881 B2
(45) Date of Patent: May 10, 2005

(54) THERMAL RECORDING MATERIALS

(75) Inventor: Hidetaka Tsukada, Tokyo (JP)

(73) Assignee: Mitsubishi Paper Mills Ltd., Tokyo (JP)

( * ) Notice: Subject to any disclaimer, the term of this patent is extended or adjusted under 35 U.S.C. 154(b) by 0 days.

(21) Appl. No.: 10/363,830

(22) PCT Filed: Sep. 5, 2001

(86) PCT No.: PCT/JP01/07712

§ 371 (c)(1),
(2), (4) Date: Jul. 15, 2003

(87) PCT Pub. No.: WO02/20278

PCT Pub. Date: Mar. 14, 2002

(65) Prior Publication Data

US 2004/0029056 A1 Feb. 12, 2004

(30) Foreign Application Priority Data

Sep. 8, 2000 (JP) ..... 2000-272703
Sep. 13, 2000 (JP) ..... 2000-277565

(51) Int. Cl.[7] ..... B41M 5/30
(52) U.S. Cl. ..... 503/216; 503/207; 503/209; 503/221; 503/226
(58) Field of Search ..... 503/207, 208, 503/209, 216, 221, 226, 217, 200

(56) References Cited

FOREIGN PATENT DOCUMENTS

| | | |
|---|---|---|
| EP | 0 467 646 | 1/1992 |
| JP | 7-149046 | 6/1995 |
| JP | 9-267558 | 10/1997 |
| JP | 9-277704 | 10/1997 |
| JP | 2727234 | 12/1997 |
| JP | 10-35109 | 2/1998 |
| JP | 10-258574 | 9/1998 |
| JP | 10-264525 | 10/1998 |
| JP | 10-264527 | 10/1998 |
| JP | 10-264529 | 10/1998 |
| JP | 10-264534 | 10/1998 |
| JP | 11-277906 | 10/1999 |
| WO | 00/35679 | 6/2000 |

*Primary Examiner*—B. Hamilton Hess
(74) *Attorney, Agent, or Firm*—Wenderoth, Lind & Ponack, L.L.P.

(57) ABSTRACT

Disclosed are a thermal recording material having a thermal recording layer containing an electron-donating dye precursor and an electron-accepting compound, wherein the thermal recording layer comprises an electron-accepting compound of the general formula (I), (I)

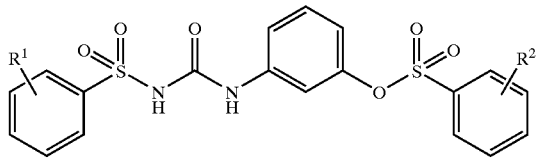

(each of $R^1$ and $R^2$ is a hydrogen atom or an alkyl group), and a specific aromatic phosphorus compound, and a thermal recording material wherein said thermal recording layer comprises the electron-accepting compound of the above general formula (I) and an undercoat layer formed on a substrate comprises an organic pigment having a specific morphological structure.

The former thermal recording material is excellent particularly in thermal response as well as heat resistance and light resistance of a ground and images in storage, and the latter thermal recording material is excellent particularly in whiteness.

21 Claims, No Drawings

THERMAL RECORDING MATERIALS

This application is a U.S. national stage of International Application No. PCT/JP01/07712 filed Sep. 5, 2001.

TECHNICAL FIELD

The present invention relates to a thermal recording material, and more specifically to a thermal recording material excellent in thermal response, heat resistance of ground and images and light resistance in storage or a thermal recording material excellent in whiteness.

TECHNICAL BACKGROUND

Generally, thermal recording materials are obtained by forming a thermal recording layer on a substrate, and the thermal recording layer contains an electron-donating generally colorless or light-colored dye precursor and an electron-accepting developer as main components. Thermal recording materials give an image to be recorded by an instant reaction between the dye precursor and the developer upon heating with a thermal head, a thermal pen or a laser beam. The above thermal recording materials have advantages that a recording is obtained with a relatively simple device, that the maintenance of the device is easy and that noise is not made much. Such thermal recording materials are therefore used in broad fields including a measuring meter, a facsimile machine, a printer, a computer terminal, a label printing machine, a ticket or card-issuing machine, and the like.

In recent years, particularly, thermal recording materials are used as receipts for gas, water and electric bills, ATM slips of banking facilities, various receipts, accounting recording sheets, thermal recording labels for POS systems, or thermal recording tags.

Use fields and demands of thermal recording materials are variously diversified, and environments in which such thermal recording materials are used are also diversified. Particularly, thermal recording materials are required to have heat resistance in storage under high-temperature environments at 80 to 100° C., particularly, in a car, a microwave oven, and further, they are required to have light resistance in storage outdoors or indoors or light resistance to sunlight through window or to a fluorescent lamp. On the other hand, there are also demands for thermal recording materials having excellent thermal response to a small energy in order to comply with decreased power consumption or rapid printing.

Thermal recording materials excellent in heat resistance in storage are disclosed in JP-A-10-35109 and JP-A-10-264525. However, the thermal recording materials are not satisfactory with regard to heat resistance in storage in an environment at 100° C. and also have low thermal response. As a method of improving the light resistance in storage, Japanese Patent No. 2727234 describes a method in which a specific anti-oxidant and ultraviolet absorbent are added. However, it cannot be said that sufficient light resistance in storage can be obtained.

Further, thermal recording materials prepared in the form of a thermal recording label or thermal recording tag are stored in high-temperature high-humidity environments in many cases, and the thermal recording materials are therefore particularly required to have high whiteness not only on a recorded image but also on a ground and are required to cause almost no change in such an image and ground.

DISCLOSURE OF THE INVENTION

Under the circumstances, it is a first object of the present invention to provide a thermal recording material excellent in thermal response, heat resistance of ground and images and light resistance in storage, and it is a second object of the present invention to provide a thermal recording material excellent in whiteness.

The present inventors have therefore made diligent studies for achieving the above object, and as a result, it has been found that the first object can be achieved by incorporating a combination of an electron-accepting compound having a specific chemical structure and an aromatic phosphorus compound having a specific chemical structure into a thermal recording layer. It has been also found that the second object can be achieved by a thermal recording material having an undercoat layer and a thermal recording layer in which the thermal recording layer contains an electron-accepting compound having a specific chemical structure and the undercoat layer contains, as a pigment, an organic pigment having a specific morphological structure. The present invention has been completed on the basis of the above findings.

That is, according to the present invention, there are provided;

(1) a thermal recording material (to be referred to as "thermal recording material I" hereinafter) comprising a thermal recording layer containing an electron-donating dye precursor and an electron-accepting compound that reacts with said dye precursor upon heating to cause said dye precursor to develop a color, said thermal recording layer comprising an electron-accepting compound of the general formula (I), (I)

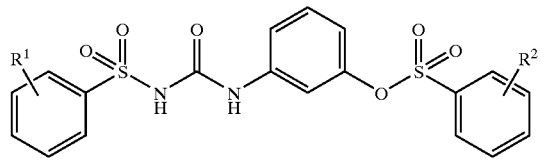

wherein each of $R^1$ and $R^2$ is independently a hydrogen atom or an alkyl group, and a compound of the general formula (II), (II)

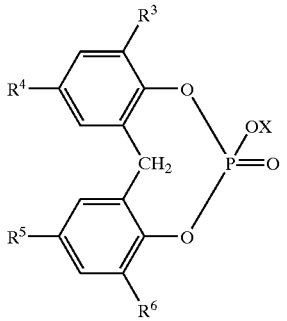

wherein each of $R^3$ to $R^6$ is independently an alkyl group, and X is a hydrogen atom, an ammonium group or a metal atom, and (2) a thermal recording material (to be referred to as "thermal recording material II" hereinafter) comprising a substrate, an undercoat layer that contains a pigment and an adhesive as main components and is formed on the substrate, and a thermal recording layer that is formed on the undercoat layer and contains an electron-donating dye precursor and an electron-accepting compound that reacts with said dye precursor upon heating to cause said dye precursor to develop a color, said thermal recording layer comprising an electron-accepting compound of the above general formula (I), and said undercoat layer comprising, as a pigment, at least one member selected from an organic pigment having a through hole, organic hollow particles having an opening portion each, or organic hollow particles substantially having no opening portion.

PREFERRED EMBODIMENTS OF THE INVENTION

The thermal recording material of the present invention includes two embodiments, a thermal recording material I and a thermal recording material II. The thermal recording material I will be explained first.

The thermal recording material I of the present invention has a thermal recording layer comprising an electron-donating dye precursor and an electron-accepting compound that reacts with said dye precursor upon heating to cause said dye precursor to develop a color. In the present invention, paper is mainly used as a substrate, while the substrate can be also selected from various woven fabrics, non-woven fabrics, a synthetic resin film, a synthetic resin laminated paper, a synthetic paper, a metal foil, a vapor deposition sheet or a composite sheet formed by combining two or more of these by bonding, as required depending upon an end use.

In the thermal recording material I of the present invention, a compound of the general formula. (I) is used as an electron-accepting compound that causes the dye precursor constituting the thermal recording layer to develop color.

(I)

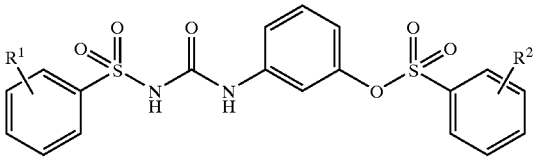

In the above general formula (I), each of $R^1$ and $R^2$ is a hydrogen atom or an alkyl group, and each may be the same as, or may be different from, other. The alkyl group preferably includes a lower alkyl group having 1 to 4 carbon atoms.

Examples of the compound of the above general formula (I) include N-(benzenesulfonyl)-N'-(3-benzenesulfonyloxyphenyl)urea, N-(benzenesulfonyl)-N'-(3-p-toluenesulfonyloxyphenyl)urea, N-(p-toluenesulfonyl)-N'-(3-p-toluenesulfonyloxyphenyl)urea, N-(p-toluenesulfonyl)-N'-(3-benzenesulfonyloxyphenyl)urea, N-(o-toluenesulfonyl)-N'-(3-p-toluenesulfonyloxyphenyl)urea and N-(p-ethylbenzenesulfonyl)-N'-(3-p-ethylbenzenesulfonyloxyphenyl)urea. However, the electron-accepting compound of the general formula (I) in the present invention shall not be limited to these. Further, two or more compounds may be used in combination as required.

Of those compounds of the general formula (I), N-(p-toluenesulfonyl)-N'-(3-p-toluenesulfonyloxyphenyl)urea is preferred.

In the thermal recording material I of the present invention, further, the thermal recording layer may contain one or more other electron-accepting compounds so long as the intended effect of the present invention is not impaired. Such electron-accepting compounds that can be used in combination are typified by electron-accepting compounds that are generally used in pressure-sensitive recording materials or thermal recording materials, while they shall not be limited thereto. Examples of the above electron-accepting compounds include a phenol derivative, an aromatic carboxylic acid derivative, an N,N'-diarylthiourea derivative, an arylsulfonylurea derivative, a polyvalent metal salt such as a zinc salt of an organic compound, and a benzenesulfoneamide derivative.

Specific examples of the above electron-accepting compounds include clay substances such as acid clay, activated clay, zeolite, bentonite and kaolin, p-phenylphenol, p-hydroxyacetophenone, 4-hydroxy-4'-methyldiphenylsulfone, 4-hydroxy-4'-isopropoxydiphenylsulfone, 4-hydroxy-4'-n-propoxydiphenylsulfone, 3-phenylsulfonyl-4-hydroxydiphenylsulfone, 3,4-dihydroxy-4'-methyldiphenylsulfone, 4-hydroxy-4'-benzenesulfonyloxydiphenylsulfone, 2,4-bis(phenylsulfonyl)phenol, N,N'-diphenylthiourea, 4,4'-bis[3-(4-methylphenylsulfonyl)ureido]diphenylmethane, N-(4-methylphenylsulfonyl)-N'-phenylurea, 1,1-bis(4-hydroxyphenyl)propane, 1,1-bis(4-hydroxyphenyl)pentane, 1,1-bis(4-hydroxyphenyl)hexane, 1,1-bis(4-hydroxyphenyl)cyclohexane, 1,1-bis(4-hydroxyphenyl)cyclododecane, 2,2-bis(4-hydroxyphenyl)propane, 2,2-bis(4-hydroxyphenyl)hexane, 2,2-bis(4-hydroxyphenyl)octane, 1,1-bis(4-hydroxyphenyl)-2-ethylhexane, 2,2-bis(3-chloro-4-hydroxyphenyl)propane, 1,1-bis(4-hydroxyphenyl)-1-phenylethane, 1,3-di-[2-(4-hydroxyphenyl)-2-propyl]benzene, 1,3-di-[2-(3,4-dihydroxyphenyl)-2-propyl]benzene, 1,4-di-[2-(4-hydroxyphenyl)-2-propyl]benzene, 4,4'-dihydroxydiphenyl ether, N-(2-hydroxyphenyl)benzenesulfoneamide, N-(2-hydroxyphenyl)-p-toluenesulfoneamide, N-(4-hydroxyphenyl)benzenesulfoneamide, N-(4-hydroxyphenyl)-p-toluenesulfoneamide, 4,4'-dihydroxydiphenylsulfone, 2,4'-dihydroxydiphenylsulfone, 3,3'-dichloro-4,4'-dihydroxydiphenylsulfone, 3,3'-diallyl-4,4'-dihydroxydiphenylsulfone, 3,3'-dichloro-4,4'-dihydroxydiphenylsulfide, methyl 2,2-bis(4-hydroxyphenyl) acetate, butyl 2,2-bis(4-hydroxyphenyl) acetate, 4,4'-thiobis(2-tert-butyl-5-methylphenol), benzyl p-hydroxybenzoate, chlorobenzyl p-hydroxybenzoate, dimethyl 4-hydroxyphthalate, benzyl gallate, stearyl gallate, salicylanilide, 5-chlorosalicylanilide, a novolak phenolic resin, a modified terpene phenolic resin, 3,5-di-tert-butylsalicylic acid, 3,5-di-tert-nonylsalicylic acid, 3,5-didodecylsalicylic acid, 3-methyl-5-tert-dodecylsalicylic acid, 5-cyclohexylsalicylic acid, 3,5-bis(α,α-dimethylbenzyl)salicylic acid, 3-methyl-5-(α-methylbenzyl)salicylic acid, and metal salts such as zinc, nickel, aluminum and calcium salts of these. The above electron-accepting compounds shall not be limited to these, and two or more compounds of these may be used in combination as required.

In the thermal recording material I of the present invention, the thermal recording layer is required to contain a compound of the general formula (II), (II)

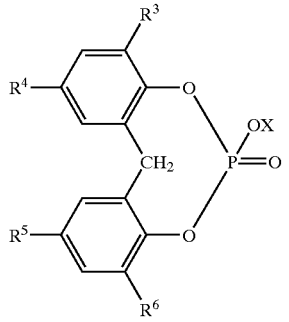

In the above general formula (II), each of $R^3$ to $R^6$ is an alkyl group, and each of them may be the same as, or may be different from, other. The above alkyl group preferably includes a linear, branched or cyclic alkyl group having 1 to 10 carbon atoms. X is a hydrogen atom, an ammonium group or a metal atom. When X is a metal atom, the metal atom includes alkali metals such as sodium and potassium.

Examples of the compound of the above general formula (II) include 2,2'-methylenebis(4,6-di-tert-butylphenyl) phosphate, an ammonium salt of 2,2'-methylenebis(4,6-di-tert-butylphenyl)phosphate, a sodium salt of 2,2'-methylenebis(4,6-di-tert-butylphenyl)phosphate and a potassium salt of 2,2'-methylenebis(4,6-di-tert-butylphenyl) phosphate. The compound of the general formula (II) in the present invention shall not be limited to these, and two or more compounds of these may be used in combination as required.

Of those compounds of the general formula (II), a sodium salt of 2,2'-methylenebis(4,6-di-tert-butylphenyl)phosphate is preferred. When used in combination with the electron-accepting compound of the above general formula (I), this compound can give a thermal recording material that is the most excellent in heat resistance of ground and images in storage.

In the thermal recording material I of the present invention, desirably, the thermal recording layer contains a benzotriazole derivative. The benzotriazole derivative is selected from various known compounds.

Specific examples of the benzotriazole derivative include 2-(2-hydroxyphenyl)benzotriazole, 2-(2-hydroxy-5-methylphenyl)benzotriazole, 2-(2-hydroxy-5-tert-butylphenyl)benzotriazole, 2-(2-hydroxy-3,5-di-tert-butylphenyl)benzotriazole, 2-(2-hydroxy-3-tert-butyl-5-methylphenyl)-5-chlorobenzotriazole, 2-(2-hydroxy-3,5-di-tert-butylphenyl)-5-chlorobenzotriazole, 2-(2-hydroxy-3,5-di-tert-aminophenyl)benzotriazole, 2-(2-hydroxy-3,5-di-tert-butylphenyl)-5-tert-butylbenzotriazole, 2-(2-hydroxy-3-dodecyl-5-methylphenyl)benzotriazole, 2-[2-hydroxy-4-(2-ethylhexyl)oxyphenyl]benzotriazole, a condensate of methyl-3-(3-tert-butyl-5-benzotriazolyl-4-hydroxyphenyl) propionate and polyethylene glycol (having a molecular weight of approximately 300), octyl 5-tert-butyl-3-(5-chloro-benzotriazolyl)-4-hydroxybenzene-propionate, 2-(2-hydroxy-3-sec-butyl-5-tert-butylphenyl)-5-tert-butylbenzotriazole, 2-(2-hydroxy-4-methoxy-5-sulfophenyl)benzotriazole sodium salt, 2-(2-hydroxy-4-butoxy-5-sulfophenyl)benzotriazole sodium salt, 2,2'-methylenebis(4-methyl-6-benzotriazolylphenol), 2,2'-methylenebis[4-methyl-6-(5-methylbenzotriazolyl)phenol], 2,2'-methylenebis[4-methyl-6-(5-chlorobenzotriazolyl) phenol], 2,2'-methylenebis[4-(1,1,3,3-tetramethylbutyl)-6-benzotriazolylphenol], 2,2'-methylenebis[(4-tert-butyl-6-benzotriazolyl)phenol], 2,2'-propylidenebis(4-methyl-6-benzotriazolylphenol), 2,2'-isopropylidenebis(4-methyl-6-benzotriazolylphenol), 2,2'-isopropylidenebis[4-(1,1,3,3-tetramethylbutyl)-6-benzotriazolylphenol] and 2,2'-octylidenebis[4-methyl-6-(5-methylbenzotriazolyl)phenol. The benzotriazole derivative in the present invention shall not be limited to these, and two or more compounds of these may be used in combination as required.

Of the benzotriazole derivatives, a benzotriazole derivative diner of the general formula (III) is particularly preferred.

(III)

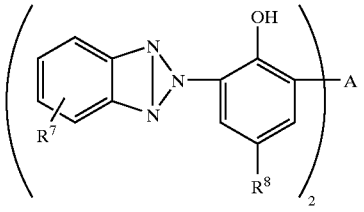

wherein $R^7$ is a hydrogen atom, an alkyl group, an alkoxyl group, an aryl group, an aryloxy group or a halogen atom, $R^8$ is an alkyl group having 1 to 18 carbon atoms, and A is an alkylidene group having 1 to 8 carbon atoms.

The above benzotriazole derivative dimer has a higher melting point than a monomer and serves to give a thermal recording material excellent in heat resistance. Further, the above dimer has excellent ultraviolet absorptivity that seems to be produced by its molecular structure, and it can therefore gives a thermal recording material excellent in light resistance of ground and images in storage when the thermal recording material is exposed directly to sunlight outdoors.

Further, one or more other ultraviolet absorbents may be used in combination so long as the intended effect of the present invention is not impaired.

Examples of the "other" ultraviolet absorbents are as follows.

(1) Benzophenone derivatives: 2,4-hydroxybenzophenone, 2-hydroxy-4-methoxybenzophenone, 2-hydroxy-4-octyloxybenzophenone, 2-hydroxy-4-dodecyloxybenzophenone, 2,2'-dihydroxy-4-methoxybenzophenone, 2,2'-dihydroxy-4,4'-dimethoxybenzophenone, 2-hydroxy-4-methoxy-5-sulfobenzophenone, 2-hydroxy-4-methoxybenzophenone-5-sulfonic acid, sodium 2-hydroxy-4-methoxybenzophenone-5-sulfonate, potassium 2-hydroxy-4-methoxybenzophenone-5-sulfonate, sodium 2,2'-dihydroxy-4,4'-dimethoxybenzopnenone-5-sulfonate, sodium 2,4-dihydroxybenzophenone-5-sulfonate, sodium 2,2'-dihydroxy-4,4'-dimethoxybenzophenone-5,5'-disulfonate, sodium 2,4-dihydroxybenzophenone-5'-sulfonate, sodium 2,2',4,4'-tetrahydroxybenzophenone-5,5'-disulfonate, etc.

(2) Salicylic acid derivatives: phenyl salicylate, p-tert-butylphenyl salicylate, p-octylphenyl salicylate, etc.

(3) Cyanoacrylate derivatives: 2-ethylhexyl-2-cyano-3,3'-diphenyl acrylate, ethyl-2-cyano-3,3'-diphenyl acrylate, etc.

(4) Hindered amine derivatives: bis(2,2,6,6-tetramethyl-4-piperidyl)sebacate, succinic acid-bis(2,2,6,6-tetramethyl-4-piperidyl) ester, 2(3,5-di-tert-butyl)malonic acid-bis(1,2,2,6,6-pentamethyl-4-piperidyl) ester, etc. Two or more ultraviolet absorbents of these may be used in combination as required.

Although not specially limited, the electron-donating dye precursor constituting the thermal recording layer of the thermal recording material I of the present invention is typified by a generally colorless or light-colored dye precursor that is generally used in a pressure-sensitive recording material or a thermal recording material.

Specific examples of the dye precursor are as follows.

(1) Triarylmethane compounds: 3,3-bis(p-dimethylaminophenyl)-6-dimethylaminophthalide (crystal violet lactone), 3,3-bis(p-dimethylaminophenyl)phthalide, 3-(p-dimethylaminophenyl)-3-(1,2-dimethylindol-3-yl) phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, etc.

(2) Diphenylmethane compounds: 4,4'-bis(dimethylaminophenyl)benzhydrylbenzyl ether, N-chlorophenyl leucoauramine, N-2,4,5-trichlorophenyl leucoauramine, etc.

(3) Xanthene compounds: rhodamine B anilinolactam, rhodamine B-p-chloroanilinolactam, 3-diethylamino-7-dibenzylaminofluorane, 3-diethylamino-7-octylaminofluorane, 3-diethylamino-7-phenylfluorane, 3-diethylamino-7-chlorofluorane, 3-diethylamino-6-chloro-7-methylfluorane, 3-diethylamino-7-(3,4-dichloroanilino)fluorane, 3-diethylamino-7-(2-chloroanilino)fluorane, 3-diethylamino-6-methyl-7-anilinofluorane, 3-dibutylamino-6-methyl-7-anilinofluorane, 3-dipentylamino-6-methyl-7-anilinofluorane, 3-(N-ethyl-N-tolyl)amino-6-methyl-7-anilinofluorane, 3-piperidino-6-methyl-7-anilinofluorane, 3-(N-ethyl-N-tolyl)amino-6-methyl-7-phenetylfluorane, 3-diethylamino-7-(4-nitroanilino)fluorane, 3-(N-methyl-N-propyl)amino-6-methyl-7-anilinofluorane, 3-(N-ethyl-N-isoamyl)amino-6-methyl-7-anilinofluorane, 3-(N-methyl-N-cyclohexyl)amino-6-methyl-7-anilinofluorane, 3-(N-ethyl-N-tetrahydrofurfuryl)amino-6-methyl-7-anilinofluorane, etc.

(4) Thiazine compounds: benzoyl leucomethylene blue, p-nitrobenzoyl leucomethylene blue, etc.

(5) Spiro compounds: 3-methylspirodinaphthopyran, 3-ethylspirodinaphthopyran, 3,3-dichlorospirodinaphthopyran, 3-benzylspirodinaphthopyran, 3-methylnaphtho-(3-methoxybenzo)spiropyran, 3-propylspirobenzopyran, etc. Two or more compounds of these dye precursors may be used in combination as required.

Of the above dye precursors, 3-(N-ethyl-N-tolyl)amino-6-methyl-7-anilinofluorane is particularly preferred. The above 3-(N-ethyl-N-tolyl)amino-6-methyl-7-anilinofluorane can give a thermal recording material excellent in heat resistance of ground and images and light resistance in storage.

In the thermal recording material I of the present invention, the thermal recording layer may contain a heat-fusible substance for improving the thermal recording layer in thermal response. The heat-fusible substance preferably has a melting point of 60 to 180° C., and particularly preferably has a melting point of 80 to 140° C.

Specific examples of the above heat-fusible substance include known heat-fusible substances such as stearamide, N-hydroxymethylstearamide, N-stearylstearamide, ethylenebisstearamide, N-stearylurea, benzyl-2-naphthyl ether, m-terphenyl, 4-benzylbiphenyl, 4-acetylbiphenyl, 4-(4-methylphenoxy)biphenyl, 1,2-bis(3-methylphenoxy)ethane, 1,2-diphenoxyethane, 2,2'-bis(4-methoxyphenoxy)diethyl ether, α,α'-diphenoxyxylene, bis(4-methoxyphenyl)ether, diphenyl adipate, dibenzyl oxalate, di(4-methylbenzyl) oxalate, di(4-chlorobenzyl)oxalate, dimethyl terephthalate, dibenzyl terephthalate, phenyl benzenesulfonic ester, diphenylsulfone, bis(4-allyloxyphenyl)sulfone, 4-acetylacetophenone, acetoacetic acid anilides, fatty acid anilides, etc. These compounds may be used alone, or two or more compounds of these may be used in combination. For obtaining sufficient thermal response, further, the thermal recording layer preferably has a heat-fusible substance content of 5 to 50% by weight based on the total solid content.

The thermal recording layer constituting the thermal recording material I of the present invention can be formed by mixing dispersions of finely pulverized color-developing components with a binder, applying the mixture onto a substrate and drying the applied mixture. The thermal recording layer may have a single-layered structure or a multi-layered structure.

The binder for use in the thermal recording layer can be selected from various binders used for general applications or coatings.

Specific examples of the binder include water-soluble binders such as starches, hydroxymethyl cellulose, methyl cellulose, ethyl cellulose, carboxymethyl cellulose, gelatin, casein, polyvinyl alcohol, modified polyvinyl alcohol, sodium alginate, polyvinyl pyrrolidone, polyacrylamide, an acrylamide/acrylic ester copolymer, an acrylamide/acrylic ester/methacrylic acid terpolymer, an alkali salt of polyacrylic acid, an alkali salt of polymaleic acid, an alkali salt of a styrene/maleic anhydride copolymer, an alkali salt of an ethylene/maleic anhydride copolymer and an alkali salt of isobutylene/maleic anhydride copolymer, and water-dispersible binders such as a styrene/butadiene copolymer, an acrylonitrile/butadiene copolymer, a methyl acrylate/butadiene copolymer, an acrylonitrile/butadiene/styrene terpolymer, polyvinyl acetate, a vinyl acetate/acrylic ester copolymer, an ethylene/vinyl acetate copolymer, a polyacrylic ester, a styrene/acrylic ester copolymer and polyurethane, while the binder shall not be limited to these.

The thermal recording layer may contain a pigment. The pigment includes inorganic pigments such as diatomaceous earth, talc, kaolin, calcined kaolin, heavy calcium carbonate, precipitated calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate and colloidal silica, and organic pigments such as a melamine resin filler, a urea-formalin resin filler, a polyethylene powder and a nylon powder.

For preventing the abrasion or sticking of a head, the thermal recording layer may contain a lubricant such as a higher fatty acid metal salt such as zinc stearate or calcium stearate, a higher fatty acid amide such as stearamide, paraffin, polyethylene wax, polyethylene oxide or castor wax, and a dispersing and wetting agent such as a surfactant including anionic and nonionic surfactants having a high molecular weight, and it may further contain a fluorescent dye and an anti-foamer as required.

The method of forming the thermal recording layer is not specially limited, and the thermal recording layer can be formed according to a conventionally known method. Specifically, the coating solution is applied onto a substrate by one of various printing methods such as an anastatic printing method, a planographic printing method, a flexographic printing method, a gravure printing method, etc., or by one of coating methods such as an air knife coating method, a rod blade coating method, a bar coating method, a blade coating method, a gravure coating method, a curtain coating method and an E bar coating method, and the thus-applied coating solution is dried, whereby the thermal recording layer can be formed.

The coating amount for the thermal recording layer is properly 0.1 to 2.0 g/m$^2$ as a coating amount of the dye precursor. When the above amount is smaller than 0.1 g/m$^2$, no sufficient recorded image can be obtained. When it exceeds 2.0 g/m$^2$, there is found no further improvement in thermal response, and such a large amount is costwise disadvantageous.

In the thermal recording material I of the present invention, at least one undercoat layer formed of a single layer or a multi-layered structure containing a pigment or a resin may be provided between the substrate and the thermal recording layer as required. When the thermal recording material I has an undercoat layer, the coating amount for the undercoat layer is preferably 1 to 30 g/m$^2$, more preferably 3 to 20 g/m$^2$.

As a pigment in the undercoat layer, generally, calcined kaolin is used. Besides, the pigment can be also selected from inorganic pigments such as diatomaceous earth, talc, kaolin, heavy calcium carbonate, precipitated calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate and colloidal silica, and organic pigments such as a melamine resin filler, a urea-formalin resin filler, a polyethylene powder and a nylon powder. It is particularly desirable to use, as a pigment, at least one member selected from an organic pigment having a through hole, organic hollow particles having an opening or organic hollow particles substantially having no opening, which will be explained as a pigment in an undercoat layer in the thermal recording material II to be described later.

The resin for use in the undercoat layer can be selected from various water-soluble resins or water-dispersible resins that are used in general coatings. Examples of such resins include water-soluble resins such as starches, hydroxymethyl cellulose, methyl cellulose, ethyl cellulose, carboxymethyl cellulose, gelatin, casein, polyvinyl alcohol, modified polyvinyl alcohol, sodium alginate, polyvinyl pyrrolidone, polyacrylamide, an acrylamide/acrylic ester copolymer, an acrylamide/acrylic ester/methacrylic acid terpolymer, an alkali salt of polyacrylic acid, an alkali salt of polymaleic acid, an alkali salt of a styrene/maleic anhydride copolymer, an alkali salt of an ethylene/maleic anhydride copolymer and an alkali salt of isobutylene/maleic anhydride copolymer, and water-dispersible resins such as a styrene/butadiene copolymer, an acrylonitrile/butadiene copolymer, a methyl acrylate/butadiene copolymer, an acrylonitrile/butadiene/styrene terpolymer, polyvinyl acetate, a vinyl acetate/acrylic ester copolymer, an ethylene/vinyl acetate copolymer, a polyacrylic ester, a styrene/acrylic ester copolymer and polyurethane.

The thermal recording material II will be explained hereinafter.

The thermal recording material II of the present invention comprises a substrate, an undercoat layer that contains a pigment and an adhesive as main components and is formed on the substrate, and a thermal recording layer that is formed on the undercoat layer and contains an electron-donating dye precursor and an electron-accepting compound that reacts with said dye precursor upon heating. to cause said dye precursor to develop a color. The above substrate is as explained with regard to the above thermal recording material I.

As an electron-accepting compound for causing the dye precursor constituting the thermal recording layer of the thermal recording material II of the present invention to develop a color, the compound of the above general formula (I) is used. The compound of the general formula (I) is as explained with regard to the above thermal recording material I.

In the thermal recording material II of the present invention, the thermal recording layer may contain one or more other electron-accepting compounds in combination so long as the effect of the present invention is not impaired. The electron-accepting compound(s) that can be used in combination are typified by electron-accepting compounds that are generally used in a pressure-sensitive recording material or a thermal recording material, while they shall not be limited to these. Examples of the above electron-accepting compounds include a phenol derivative, an aromatic carboxylic acid derivative, an N,N'-diarylthiourea derivative, an arylsulfonylurea derivative, a polyvalent metal salt such as a zinc salt of an organic compound, and a benzenesulfoneamide derivative.

Specific examples of the above "other" electron-accepting compounds are as explained with regard to the above thermal recording material I.

In the thermal recording material II of the present invention, the thermal recording layer preferably contains a compound of the above general formula (II). The compound of the general formula (II) is as explained with regard to the above thermal recording material I. When the compound of the above general formula (II) is used in combination with the electron-accepting compound of the above general formula (I), there can be obtained a thermal recording material excellent in heat resistance of ground and images in storage.

In the thermal recording material II of the present invention, the thermal recording layer preferably contains a benzotriazole derivative or other ultraviolet absorbent. In this case, there can be obtained a thermal recording material excellent in light resistance of ground and images in storage. The benzotriazole derivative and the "other" ultraviolet absorbent are as explained with regard to the above thermal recording material I, and a benzotriazole derivative dimer of the above general formula (III) is particularly preferred in view of an effect.

The electron-donating dye precursor for constituting the thermal recording layer of the thermal recording material II of the present invention is typified by generally colorless or light-colored dye precursors that are generally used in a pressure-sensitive recording material or a thermal recording material, while the electron-donating dye precursor shall not be specially limited thereto. Specific examples of the above dye precursor are as explained with regard to the above thermal recording material I.

In the thermal recording material II of the present invention, other materials for constituting the thermal recording layer, the layer structure of the thermal recording layer and the method for forming the thermal recording layer are as explained with regard to the above thermal recording material I.

In the thermal recording material II of the present invention, an undercoat layer containing a pigment and an adhesive as main components is formed on the substrate. The pigment for constituting the undercoat layer is at least one member selected from an organic pigment having a through hole, organic hollow particles having an opening or organic hollow particles substantially having no opening.

The organic pigment having a through hole can be organic pigment particles having at least one through hole each. The above organic pigment having a through hole can be obtained, for example, by employing resin particles soluble in a alkaline-water such as sodium hydroxide, ammonium hydroxide, potassium hydroxide, triethylamine or the like as a core material and eluting said core material with alkaline water while forming an alkaline-water-insoluble resin layer around each particle.

The alkaline-water-soluble resin particles are particles of a copolymer formed by emulsion-polymerization of at least one member selected from hydrophobic monomers such as styrene, methyl(meth)acrylate, ethyl(meth)acrylate, butyl (meth)acrylate, etc., and at least member selected from vinyl monomers of unsaturated carboxylic acids such as (meth) acrylic acid, itaconic acid, crotonic acid, and the like. The amount of the unsaturated carboxylic acid monomer based on the total monomer amount is preferably approximately 10 to 50% by weight.

The alkaline-water-insoluble resin can be a resin obtained by polymerization of at least one of the above hydrophobic monomers. Above all, a resin formed from styrene as a monomer can produce an effect that a decrease in density of a recorded portion with the passage of time can be minimized. Further, at least one member of the above vinyl monomers of the unsaturated carboxylic acids may be used as a comonomer for the above polymerization so long as a formed resin is not dissolved in alkaline water.

When the volume average particle diameter of the organic pigment having a through hole is less than 0.1 μm, the density of the undercoat layer increases, and there may be caused an increase in thermal conductivity, to cause the sensitivity to decrease. Further, the amount of oil that can be absorbed may decrease to cause the formation of a head dust. When the above volume average particle diameter exceeds 2.0 μm, the undercoat layer is no longer formed uniformly, and the image quality may be caused to deteriorate or the surface strength may be caused to decrease. The volume average particle diameter of the above organic particle is therefore preferably approximately 0.1 to 2.0 μm, more preferably approximately 0.2 to 1.5 μm.

The organic hollow particles having an opening portion has a characteristic structure in which the opening portion is formed by cutting part of each organic hollow particle with a flat plane, and the organic hollow particles can have various forms such as the form of a jar, pot, bowl, a cone, or the like. The average maximum diameter of the organic hollow particles having the above opening is generally 0.3 to 5 μm, preferably 0.5 to 3 μm. The ratio of an average equivalent diameters of the opening portions to the average maximum diameter of the particles is generally 25 to 100%, preferably 60 to 95%.

The organic hollow particles having an opening portion for use in the present invention generally has a thick-wall portion having a multi-layered polymer structure, and as one embodiment of the method of producing such organic hollow particles, there can be employed a multi-stage polymerization method comprising the following steps (1) to (7).

(1) copolymerizing a monomer mixture containing 30 to 65% by weight of an acid-group-containing monomer and a 70 to 35% by weight of a monomer copolymerizable therewith, to prepare core polymer particles, (2) copolymerizing a monomer mixture containing 10 to 35% by weight of an acid-group-containing monomer and 90 to 65% by weight of a monomer copolymerizable therewith, in the presence of the above core polymer particles, to form a shell polymer substantially surrounding the above core polymer particles each (provided that the content of the acid-group-containing monomer in the shell polymer is equivalent to, or smaller than, the content of the acid-group-containing monomer in the core polymer), (3) copolymerizing a monomer mixture containing 1 to 12% by weight of an acid-group-containing monomer and 99 to 88% by weight of a monomer copolymerizable therewith, in the presence of the above core/shell polymer particles, to form an intermediate layer polymer formed of at least one layer substantially surrounding the above shell polymer particles each, (4) copolymerizing an aromatic vinyl monomer alone or a monomer mixture containing 0.5% or less by weight of an acid-group-containing monomer and at least 99.5% by weight of an aromatic vinyl monomer copolymerizable therewith, in the presence of the above polymer particles having the intermediate layer polymer formed so as to surround the shell polymer particles each, to form an outer layer polymer substantially surrounding the above intermediate layer polymer, (5) adding a base to an aqueous dispersion containing the thus-obtained polymer particles having a structure formed of at least four layers, to adjust the pH of the dispersion to at least 7 and to form a void in each polymer particle, (6) optionally adjusting the pH of the dispersion to less than 7, adding an aromatic vinyl monomer alone or a monomer mixture containing at least 90% by weight of an aromatic vinyl monomer and 10% by weight or less of a monomer copolymerizable therewith to the aqueous dispersion, and polymerizing the aromatic vinyl monomer or the monomer mixture in the presence of the above polymer particles having the structure of at least four layers, to form an outermost layer polymer around the outer layer polymer, and then (7) drying the thus-obtained dispersion of the polymer particles.

Examples of the organic hollow particles substantially having no opening portion include particles having a shell each, the shell being made of a resin formed mainly from any one of monomers such as vinyl chloride, vinylidene chloride, vinyl acetate, methyl acrylate, ethyl acrylate, methyl methacrylate, acrylonitrile and styrene, or a copolymer resin formed from any one of the above monomers as a main comonomer. The average particle diameter of the above pigment is approximately 0.5 to 20 μm, preferably 0.5 to 3 μm. Further, the organic hollow particles preferably have a hollowness degree (ratio of volume of hollow portions inside individual particles to a total volume of particles) of approximately 50 to 98%.

Although not specially limited, the content of the organic pigment in the undercoat layer in the present invention is preferably 20 to 95% by weight based on the total solid content of the undercoat layer. When the content of the organic pigment is less than 20% by weight, a head dust is liable to be formed. When it exceeds 95% by weight, a sticking trouble may occur during printing. The content of the organic pigment is more preferably 40 to 95% by weight.

The undercoat layer may contain other known pigment so long as the intended effect of the present invention is not impaired. The "other" pigment includes organic pigments such as a nylon resin filler, a urea-formalin resin filler and a hollow resin particle filler, and inorganic pigments such as calcium carbonate, aluminum hydroxide, kaolin, calcined kaolin, silica and aluminum silicate.

The adhesive for use in the undercoat layer in combination of the specific organic pigment includes those water-soluble resins or water-dispersible resins explained with regard to the undercoat layer in the above thermal recording material I.

The content of the specific organic pigment based on the total solid content in the undercoat layer is preferably approximately 20 to 95 % by weight, and the content of the adhesive based on the total solid content in the undercoat layer is preferably approximately 5 to 35 % by weight.

The undercoat layer can be formed by mixing stirring the organic pigment, the adhesive and, optionally, an auxiliary agent, together with water as a medium to prepare an undercoat layer coating solution, applying the coating solution (dispersion) on the substrate so as to form a coating having a dry weight of 1 to 30 g/m$^{2'}$ more preferably approximately 3 to 20 g/m$^2$, and drying the applied solution. The auxiliary agent to be contained in the undercoat layer includes known pigments, surfactants, coloring dyes, fluorescent dyes, lubricants and ultraviolet absorbents.

In each of the thermal recording materials I and II of the present invention, a protective layer may be formed on the thermal recording layer as required for improving the chemical resistance of a recorded portion or improving running properties during recording. The protective layer is formed by preparing a solution or dispersion containing a water-soluble or water-dispersible resin as a main component and an adhesive, optionally adding the above ultraviolet absorbent and an auxiliary agents that can be added to the thermal recording layer to the solution or dispersion to prepare a protective layer coating solution (dispersion), applying the protective layer coating solution onto the thermal recording layer so as to form a coating generally having a dry weight of 0.2 to 10 g/m$^2$, more preferably 0.5 to 5 g/m$^2$ and drying the applied solution.

The water-soluble or water-dispersible resin for the protective layer can be selected from conventionally known water-soluble or water-dispersible resins as required. That is, the water-soluble resin includes, for example, polyvinyl alcohol, modified polyvinyl alcohol, starch or a derivative thereof, cellulose derivatives such as hydroxyethyl cellulose, methyl cellulose, ethyl cellulose and carboxylmethyl cellulose, polyvinylpyrrolidone, polyacrylamide, an acrylamide/acrylic ester copolymer, an acrylamide/acrylic ester/methacrylic acid terpolymer, an alkali salt of polyacrylic acid, an alkali salt of polymaleic acid, an alkali salt of a styrene/maleic anhydride copolymer, an alkali salt of an ethylene/maleic anhydride copolymer, an alkali salt of an isobutylene/maleic anhydride copolymer, sodium alginate, gelatin, casein and an acid neutralization product of chitosan.

The water-dispersible resin includes, for example, a styrene/butadiene copolymer, an acrylonitrile/butadiene copolymer, a methyl acrylate/butadiene copolymer, an acrylonitrile/butadiene/styrene terpolymer, polyvinyl acetate, a vinyl acetate/acrylic ester copolymer, an ethylene/vinyl acetate copolymer, polyacrylic ester, a styrene/acrylic ester copolymer and polyurethane.

Of these, carboxy-modified polyvinyl alcohol, acetoacetyl-modified polyvinyl alcohol, silicon-modified polyvinyl alcohol and diacetone-modified polyvinyl alcohol are preferred as a water-soluble resin for the protective layer, since they can form a strong coating film.

Further, the protective layer may contain a pigment for improving running properties during printing, writing quality and the like. Specific examples of the above pigment include inorganic pigments such as diatomaceous earth, talc, kaolin, calcined kaolin, heavy calcium carbonate, precipitated calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate and colloidal silica, and organic pigments such as a melamine resin filler, a urea-formalin resin filler, a polyethylene powder and a nylon powder.

For improving running properties during recording, such as prevention of head abrasion and sticking, the protective layer may contain a lubricant such as a higher fatty acid metal salt such as zinc stearate or calcium stearate, a higher fatty acid amide such as stearamide, paraffin, polyethylene wax, polyethylene oxide or castor wax.

The method for forming each of the undercoat layer and the protective layer is not critical, and these layers can be formed according to conventionally known methods. Specifically, a coating solution (dispersion) is applied by one of various printing methods and coating methods such as an air knife coating method, a rod blade coating method, a bar coating method, a blade coating method, a gravure coating method, a curtain coating method or an E bar coating method and drying the applied solution.

In the thermal recording materials I and II of the present invention, a protective layer (barrier) may be formed on the reverse surface of each thermal recording material, an adhesive agent layer may be formed, any information recording layer such as a magnetic recording layer or an inkjet recording layer may be formed, or after each layer is formed, super calendering may be carried out for surface smoothening.

The present invention will be explained with reference to Examples hereinafter, while the present invention shall not be limited by these Examples. In Examples, "part" stands for "part by weight", and a coating amount stands for a completely dry amount.

PREPARATION EXAMPLE 1

Preparation of Dispersions A to J

<Dispersion A>

200 Grams of 3-(N-ethyl-N-tolyl)amino-6-methyl-7-anilinofluorane was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 1 μm, to give Dispersion A.

<Dispersion B>

200 Grams of 3-dibutylamino-6-methyl-7-anilinofluorane was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 1 μm, to give Dispersion B.

<Dispersion C>

200 Grams of 3-(p-toluenesulfonyl)-N'-(3-p-toluenesulfonyloxyphenyl)urea was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 0.7 μm, to give Dispersion C.

<Dispersion D>

200 Grams of sodium-2,2'-methylenebis(4,6-di-tert-butylphenyl)phosphate was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 0.7 μm, to give Dispersion D.

<Dispersion E>

200 Grams of 2,2-bis(4-hydroxyphenyl)propane was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 0.7 μm, to give Dispersion E.

<Dispersion F>

200 Grams of 4-hydroxy-4'-isopropoxydiphenylsulfone was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 0.7 μm, to give Dispersion F.

<Dispersion G>

200 Grams of 2-(2-hydroxy-5-methylphenyl) benzotriazole was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 0.7 μm, to give Dispersion G.

<Dispersion H>

200 Grams of 2,2'-methylenebis[4-(1,1,3,3-tetramethylbutyl)-6-benzotriazolylphenol] was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 0.7 μm, to give Dispersion H.

<Dispersion I>

200 Grams of 2,4-dihydroxybenzophenone was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 0.7 μm, to give Dispersion I.

<Dispersion J>

200 Grams of aluminum hydroxide was dispersed in 800 g of a 0.5 wt % sodium polyacrylate aqueous solution, and the resultant mixture was stirred with a homo-mixer for 10 minutes, to give Dispersion J.

EXAMPLE 1

(1) Preparation of Thermal Recording Layer Coating Solution

Some of Dispersions obtained in Preparation Example 1 and other materials were mixed in amounts shown below, water was added to the mixture to form an aqueous solution having a thermal recording layer coating concentration of 15% by weight, and the resultant mixture was fully stirred to give a thermal recording layer coating solution.

| | |
|---|---|
| Dispersion A | 30 parts |
| Dispersion C | 70 parts |
| Dispersion D | 7 parts |
| Dispersion J | 50 parts |
| 40 wt % Zinc stearate dispersion | 10 parts |
| 10 wt % Completely saponified polyvinyl alcohol (PVA) aqueous solution | 40 parts |

(2) Preparation of Thermal Recording Material Substrate

An undercoat layer coating solution having the following composition was applied onto wood-free paper having a basis weight of 40 g/m$^2$ so as to form a coating having a coating weight of 10 g/m$^2$, and the applied coating solution was dried to obtain a thermal recording material substrate.

| | |
|---|---|
| Calcined kaolin | 100 parts |
| 50 wt % Styrene-butadiene latex | 24 parts |
| Water | 200 parts |

(3) Preparation of Thermal Recording Material

The thermal recording layer coating solution prepared in (1) was applied onto the thermal recording material substrate prepared in (2) so as to form a coating having a coating weight as a dye precursor of 0.5 g/m$^2$, and the applied coating solution was dried to give a thermal recording material.

EXAMPLE 2

A thermal recording material was obtained in the same manner as in Example 1 except that Dispersion G in an amount shown below was added to the thermal recording layer coating solution in Example 1.

| | |
|---|---|
| Dispersion G | 1 part |

EXAMPLE 3

A thermal recording material was obtained in the same manner as in Example 1 except that Dispersion H in an amount shown below was added to the thermal recording layer coating solution in Example 1.

| | |
|---|---|
| Dispersion H | 1 part |

EXAMPLE 4

A thermal recording material was obtained in the same manner as in Example 1 except that Dispersions G and H in amounts shown below were added to the thermal recording layer coating solution in Example 1.

| | |
|---|---|
| Dispersion G | 1 part |
| Dispersion H | 1 part |

EXAMPLE 5

A thermal recording material was obtained in the same manner as in Example 1 except that Dispersion A was replaced with Dispersion B.

EXAMPLE 6

A thermal recording material was obtained in the same manner as in Example 2 except that Dispersion G was replaced with Dispersion I.

COMPARATIVE EXAMPLE 1

A thermal recording material was obtained in the same manner as in Example 1 except that Dispersion D was not added.

COMPARATIVE EXAMPLE 2

A thermal recording material was obtained in the same manner as in Comparative Example 1 except that Dispersion C was replaced with Dispersion E.

COMPARATIVE EXAMPLE 3

A thermal recording material was obtained in the same manner as in Comparative Example 1 except that Dispersion C was replaced with Dispersion F.

COMPARATIVE EXAMPLE 4

A thermal recording material was obtained in the same manner as in Example 1 except that Dispersion C in Example 1 was replaced with Dispersion F.

Table 1 shows main components of thermal recording layer coating solutions for the thermal recording materials prepared in Examples 1 to 6 and Comparative Examples 1 to 4.

TABLE 1

Main components of thermal recording layer coating solution

| Ex. No. | Dye precursor | Electron accepting compound | Aromatic phosphorus compound | UV absorbent ① | UV absorbent ② | Aluminum hydroxide |
|---|---|---|---|---|---|---|
| Ex. 1 | A | C | D | — | — | J |
| | 6 | 14 | 1.4 | | | 10 |
| Ex. 2 | A | C | D | G | — | J |
| | 6 | 14 | 1.4 | 0.2 | | 10 |
| Ex. 3 | A | C | D | H | — | J |
| | 6 | 14 | 1.4 | 0.2 | | 10 |
| Ex. 4 | A | C | D | G | H | J |
| | 6 | 14 | 1.4 | 0.2 | 0.2 | 10 |
| Ex. 5 | B | C | D | — | — | J |
| | 6 | 14 | 1.4 | | | 10 |
| Ex. 6 | A | C | D | I | — | J |
| | 6 | 14 | 1.4 | 0.2 | | 10 |
| CEx. 1 | A | C | — | — | — | J |
| | 6 | 14 | | | | 10 |
| CEx. 2 | A | E | — | — | — | J |
| | 6 | 14 | | | | 10 |
| CEx. 3 | A | F | — | — | — | J |
| | 6 | 14 | | | | 10 |
| CEx. 4 | A | F | D | — | — | J |
| | 6 | 14 | 1.4 | | | 10 |

"Dispersion" shown above, and "part" shown below
Ex. = Example,
CEx. = Comparative Example The thermal-recording-layer-coating-solution-applied surface of each of the thermal recording materials obtained in Examples 1 to 6 and Comparative Examples 1 to 4 was calendered so as to have a BEKK smoothness of 300 to 800 seconds, and the thermal recording materials were evaluated as follows. Table 2 shows the results of the evaluations.

[Thermal Response Test]

Printing was made with a facsimile tester TH-PMD supplied by Okura Denki Ltd. A thermal head having a dot density of 8 dots/mm and a head resistance of 1,685Ω was used, and the printing was carried out at a head voltage of 21 V at a pulse width of 1.4 msec, to give an image. The image and a non-printed ground were measured for a density with a Macbeth RD-918 reflection densitometer (visual filter). An image which has a larger value shows that a thermal recording material has better thermal response, and a non-printed ground which has a smaller value is with less fogging and shows that a thermal recording material is excellent.

[Test of Heat Resistance in Storage]

The thermal recording material having the image obtained in the thermal response test was stored under a 100° C. condition for 24 hours, and the image and the ground were measured for a density with a Macbeth RD-918 reflection densitometer (visual filter). An image which has a larger value shows that a thermal recording material has better heat resistance in storage, and a ground which shows a smaller value is with less fogging caused by heat and shows that a thermal recording material is excellent in heat resistance in storage.

[Test of Light Resistance in Storage]

The thermal recording material having the image obtained in the thermal response test was exposed to light having a radiation dose of 0.39 W/m$^2$ at 340 nm with a xenon arc weatherometer (supplied by Atlas Ltd.) under conditions of 40° C. and a relative humidity of 90% for 24 hours, and then the image and the ground were measured for a density with a Macbeth RD-918 reflection densitometer(visual filter). An image which has a larger value shows that a thermal recording material has better light resistance in storage, and a ground which shows a smaller value is with less fogging caused by light and shows that a thermal recording material is excellent in light resistance in storage.

TABLE 2

| | Thermal Response | | Heat resistance in storage | | Light resistance in storage | |
|---|---|---|---|---|---|---|
| | Ground | Image | Ground | Image | Ground | Image |
| Example 1 | 0.05 | 1.37 | 0.16 | 1.29 | 0.11 | 1.25 |
| Example 2 | 0.05 | 1.43 | 0.19 | 1.36 | 0.09 | 1.30 |
| Example 3 | 0.05 | 1.37 | 0.13 | 1.31 | 0.07 | 1.33 |
| Example 4 | 0.05 | 1.41 | 0.14 | 1.36 | 0.07 | 1.38 |
| Example 5 | 0.05 | 1.40 | 0.20 | 1.38 | 0.14 | 1.20 |
| Example 6 | 0.05 | 1.41 | 0.22 | 1.39 | 0.10 | 1.26 |
| CEx. 1 | 0.05 | 1.29 | 0.30 | 1.02 | 0.15 | 1.10 |
| CEx. 2 | 0.06 | 1.33 | 0.52 | 0.91 | 0.25 | 1.18 |
| CEx. 3 | 0.05 | 1.28 | 0.48 | 0.99 | 0.20 | 0.22 |
| CEx. 4 | 0.05 | 1.31 | 0.45 | 1.05 | 0.20 | 0.35 |

As is clear from the above Table 2, the thermal recording materials in Examples 1 to 6 have excellent thermal response, and heat resistance and light resistance of images and ground in storage over those in Comparative Examples 1 to 4. The above effects are produced since the thermal recording layers contain the electron-accepting compound of the general formula (I) and the compound of the general formula (II).

The thermal recording materials in Examples 2 to 4 have excellent light resistance of images and ground in storage over those in Examples 1 and 6. This effect is produced since the thermal recording layers contain the benzotriazole derivative.

The thermal recording material in Example 3 has excellent heat resistance and light resistance of a ground in storage over the thermal recording material in Example 2. This effect is produced since the thermal recording layer contains the benzotriazole derivative dimer of the general formula (III).

The thermal recording material in Example 1 has excellent heat resistance of a ground in storage and excellent light resistance of a ground and images in storage over the thermal recording material in Example 5. These effects are produced since the thermal recording layer contains, as a dye precursor, 3-(N-ethyl-N-tolyl)amino-6-methyl-7-anilinofluorane.

PREPARATION EXAMPLE 2

Preparation of Dispersions K to R

<Dispersion K>

200 Grams of 3-(N-ethyl-N-tolyl)amino-6-methyl-7-anilinofluorane was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 1 μm, to give Dispersion K.

<Dispersion L>

200 Grams of N-(p-toluenesulfonyl)-N'-(3-p-toluenesulfonyloxyphenyl)urea was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 0.7 μm, to give Dispersion L.

<Dispersion M>

200 Grams of 2,2-bis(4-hydroxyphenyl)propane was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 0.7 μm, to give Dispersion M.

<Dispersion N>

200 Grams of 4-hydroxy-4'-isopropoxydiphenylsulfone was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 0.7 μm, to give Dispersion N.

<Dispersion O>

200 Grams of sodium-2,2'-methylenebis(4,6-di-tert-butylphenyl)phosphate was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 0.7 μm, to give Dispersion O.

<Dispersion P>

200 Grams of 2-(2-hydroxy-5-methylphenyl) benzotriazole was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 0.7 μm, to give Dispersion P.

<Dispersion Q>

200 Grams of 2,2'-methylenebis[4-(1,1,3,3-tetramethylbutyl)-6-benzotriazolylphenol] was dispersed in a mixture of 200 g of a 10 wt % sulfone-group-modified polyvinyl alcohol aqueous solution with 600 g of water, and the resultant mixture was pulverized with a beads-applied mill until the mixture had an average particle diameter of 0.7 μm, to give Dispersion Q.

<Dispersion R>

200 Grams of aluminum hydroxide was dispersed in 800 g of a 0.5 wt % sodium polyacrylate salt aqueous solution, and the resultant mixture was stirred with a homo-mixer for 10 minutes, to give Dispersion R.

EXAMPLE 7

(1) Preparation of Undercoat Layer Coating Solution

| | |
|---|---|
| Dispersion containing 20% of organic pigment having an opening portion (V1005, supplied by Nippon Zeon Corporation) | 500 parts |
| 50 wt % Styrene-butadiene latex | 24 parts |

The above components were mixed, water was added to the mixture to form an aqueous solution having an undercoat layer coating concentration of 30% by weight, and the resultant mixture was fully stirred to give an undercoat layer coating solution.

(2) Preparation of Thermal Recording Layer Coating Solution

Some of Dispersions obtained in Preparation Example 2 and other materials were mixed in amounts shown below, water was added to the mixture to form an aqueous solution having a thermal recording layer coating concentration of 15% by weight, and the resultant mixture was fully stirred to give a thermal recording layer coating solution.

| | |
|---|---|
| Dispersion K | 30 parts |
| Dispersion L | 70 parts |
| Dispersion P | 1 part |
| Dispersion Q | 1 parts |
| Dispersion R | 50 parts |
| 40 wt % Zinc stearate dispersion | 10 parts |
| 10 wt % Completely saponified polyvinyl alcohol (PVA) aqueous solution | 40 parts |

(3) Preparation of Thermal Recording Material

The undercoat layer coating solution prepared in (1) was applied onto one surface of a woodfree paper having a basis weight of 40 g/m$^2$ so as to form an undercoat layer having a solid content coating amount of 10 g/m$^2$, and the applied coating solution was dried to form an undercoat layer. Then, the thermal recording layer coating solution prepared in (2) was applied thereon so as to form a coating having a solid content coating amount, as a dye precursor coating amount, of 0.3 g/m$^2$, and the applied coating solution was dried to form a thermal recording layer, whereby a thermal recording material was obtained.

EXAMPLE 8

A thermal recording material was obtained in the same manner as in Example 7 except that the composition for the undercoat layer coating solution was replaced as shown below.

| | |
|---|---|
| Dispersion containing 20% of organic pigment having a through hole (GLOSS DELL 2000TX, supplied by Mitsui Chemical Inc.) | 500 parts |
| 50 wt % Styrene-butadiene latex | 24 parts |

EXAMPLE 9

A thermal recording material was obtained in the same manner as in Example 7 except that the composition for the undercoat layer coating solution was replaced as shown below.

| | |
|---|---|
| Dispersion containing 20% of hollow particulate organic pigment (RORAQUE HP-91 supplied by Rohm & Haas Ltd.) | 500 parts |
| 50 wt % Styrene-butadiene latex | 24 parts |

EXAMPLE 10

A thermal recording material was obtained in the same manner as in Example 7 except that the composition for the undercoat layer coating solution was changed as shown below and that an applied coating solution for an undercoat layer was foamed by heating with a dryer at 150° C. for 3 minutes to form an undercoat layer.

| | |
|---|---|
| Foaming plastic filler (MICROPEARL, supplied by Matsumoto Yushi Seiyaku Co., Ltd.) | 500 parts |
| 50 wt % Styrene-butadiene latex | 24 parts |

EXAMPLE 11

A thermal recording material was obtained in the same manner as in Example 7 except that Dispersion O in the following amount was added when the thermal recording layer coating solution in Example 7 was prepared.

| | |
|---|---|
| Dispersion O | 7 parts |

EXAMPLE 12

A thermal recording material was obtained in the same manner as in Example 7 except for the following. A protective layer coating solution having the following composition was applied onto the thermal recording layer of the same thermal recording material as that in Example 7, so as to form a coating having a solid content coating amount of 2 g/m$^2$, and the applied coating solution was dried to form a protective layer.

| | |
|---|---|
| 10 wt % Acetoacetyl-modified polyvinyl alcohol (GOHSEFIMER Z-200, supplied by Nippon Synthetic Chemical Industry Co., Ltd.) | 300 parts |
| Kaolin (UW-90, supplied by Engelhard Ltd.) | 65 parts |
| 10 wt % Glyoxal aqueous solution | 3 parts |
| 40 wt % Zinc stearate dispersion | 5 parts |
| Water | 150 parts |

EXAMPLE 13

A thermal recording material was obtained in the same manner as in Example 7 except that the composition for the undercoat layer coating solution was changed as shown below.

| | |
|---|---|
| Dispersion containing 20% organic pigment having an opening portion (V1005, supplied by Nippon Zeon Corporation) | 250 parts |
| Calcined kaolin | 50 parts |
| 50% Styrene-butadiene latex | 24 parts |
| Water | 100 parts |

COMPARATIVE EXAMPLE 5

A thermal recording material was obtained in the same manner as in Example 7 except that the composition for the undercoat layer coating solution was changed as shown below.

| | |
|---|---|
| Calcined kaolin | 100 parts |
| 50% Styrene-butadiene latex | 24 parts |
| Water | 400 parts |

COMPARATIVE EXAMPLE 6

A thermal recording material was obtained in the same manner as in Comparative Example 5 except that Dispersion L was replaced with Dispersion M when the thermal recording layer coating solution in Comparative Example 5 was prepared.

COMPARATIVE EXAMPLE 7

A thermal recording material was obtained in the same manner as in Example 8 except that Dispersion L was replaced with Dispersion M when the thermal recording layer coating solution in Example 8 was prepared.

COMPARATIVE EXAMPLE 8

A thermal recording material was obtained in the same manner as in Example 8 except that Dispersion L was replaced with Dispersion N when the thermal recording layer coating solution in Example 8 was prepared.

Table 3 shows pigments in the undercoat layers and main components of the thermal recording layer coating solutions for the thermal recording materials prepared in Examples 7 to 13 and Comparative Examples 5 to 8.

TABLE 3

| Ex. | Main components of TRLCS*1) | | | | | | Pigment in undercoat |
|---|---|---|---|---|---|---|---|
| | Dye Pre.* | | | UA*5) | | | |
| No. | 2) | EAC*3) | APC*4) | ① | ② | AH*6) | layer |
| Ex. 7 | K | L | — | P | Q | R | 20% Organic |
| | 6 | 14 | | 0.2 | 0.2 | 10 | pigment*7) |
| Ex. 8 | K | L | — | P | Q | R | 20% Organic |
| | 6 | 14 | | 0.2 | 0.2 | 10 | pigment*8) |
| Ex. 9 | K | L | — | P | Q | R | 20% Hollow |
| | 6 | 14 | | 0.2 | 0.2 | 10 | pigment*9) |
| Ex. 10 | K | L | — | P | Q | R | Foamable |
| | 6 | 14 | | 0.2 | 0.2 | 10 | plastic |
| Ex. 11 | K | L | O | P | Q | R | 20% Organic |
| | 6 | 14 | 1.4 | 0.2 | 0.2 | 10 | pigment*7) |
| Ex. 12 | K | L | — | P | Q | R | 20% Organic |
| | 6 | 14 | | 0.2 | 0.2 | 10 | pigment*7) |
| Ex. 13 | K | L | — | P | Q | R | 20% Organic |
| | 6 | 14 | | 0.2 | 0.2 | 10 | pigment*7) + inorganic pigment (calcined kaolin) |
| CEx. 5 | K | L | — | P | Q | R | Inorganic |
| | 6 | 14 | | 0.2 | 0.2 | 10 | pigment (calcined kaolin) |
| CEx. 6 | K | M | — | P | Q | R | Inorganic |
| | 6 | 14 | | 0.2 | 0.2 | 10 | pigment (calcined kaolin) |
| CEx. 7 | K | M | — | P | Q | R | 20% Organic |
| | 6 | 14 | | 0.2 | 0.2 | 10 | pigment*8) |
| CEx. 8 | K | N | — | P | Q | P | 20% Organic |
| | 6 | 14 | | 0.2 | 0.2 | 10 | pigment*8) |

"Dispersion" shown above, and "part" shown below
Ex. = Example,
CEx. = Comparative Example
TRLCS*1) = thermal recording layer coating solution
Dye Pre.*2) = Dye precursor
EAC*3) = Electron-accepting compound
APC*4) = Aromatic phosphorus compound
UA*5) = Ultraviolet absorbent
AH*6) = Aluminum hydroxide
*7) = Dispersion containing 20% of organic pigment having an opening portion
*8) = Dispersion containing 20% of organic pigment having a through hole
*9) = Dispersion containing 20% hollow particulate pigment The thermal-recording-layer-coating-solution-applied surface of each of the thermal recording materials obtained in Examples 7 to 13 and Comparative Examples 5 to 8 was calendered so as to have a BEKK smoothness of 300 to 800 seconds, and the thermal recording materials were evaluated as follows. Table 4 shows the results of the evaluation.

[Whiteness Test]

A thermal recording material was measured for a whiteness with a digital hunter reflectometer (umber filter) supplied by Toyo Seiki Seisakusho Ltd. immediately after the thermal recording material was prepared and was also measured after it was stored at 40° C. at a relative humidity of 90%, or under a condition of 60° C. or 80° C., for 24 hours. A thermal recording material having a larger value has better whiteness.

TABLE 4

| | Whiteness | | | |
|---|---|---|---|---|
| | Non-treated | 40° C./90% | 60° C. | 80° C. |
| Example 7 | 91 | 90 | 88 | 85 |
| Example 8 | 90 | 88 | 86 | 84 |
| Example 9 | 91 | 89 | 88 | 85 |
| Example 10 | 90 | 87 | 86 | 82 |
| Example 11 | 92 | 92 | 91 | 88 |
| Example 12 | 89 | 87 | 85 | 82 |
| Example 13 | 90 | 89 | 87 | 84 |
| CEx. 5 | 83 | 80 | 78 | 74 |
| CEx. 6 | 78 | 74 | 71 | 65 |
| CEx. 7 | 84 | 79 | 75 | 68 |
| CEx. 8 | 85 | 81 | 78 | 69 |

CEx. = Comparative Example

As is clear from the above Table 4, the thermal recording materials in Examples 7 to 13 have excellent whiteness over those in Comparative Examples 5 to 8. This effect is produced since the thermal recording layers contain the electron-accepting compound of the general formula (I) and since the undercoat layers contain, as a pigment, the organic pigment having a through hole, the organic hollow particles having an opening portion or the organic hollow particles substantially having no opening portion.

INDUSTRIAL UTILITY

According to the present invention, there can be provided a thermal recording material excellent particularly in thermal response as well as heat resistance and light resistance of a ground and images in storage, or a thermal recording material excellent particularly in whiteness.

What is claimed is:

1. A thermal recording material comprising a thermal recording layer containing an electron-donating dye precursor and an electron-accepting compound that reacts with said dye precursor upon heating to cause said dye precursor to develop a color, said thermal recording layer comprising an electron-accepting compound of the general formula (I), (I)

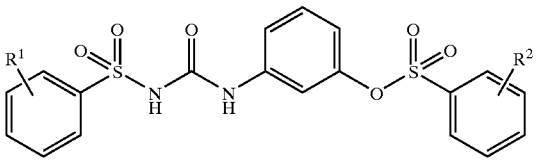

wherein each of $R^1$ and $R^2$ is independently a hydrogen atom or an alkyl group, and a compound of the general formula (II), (II)

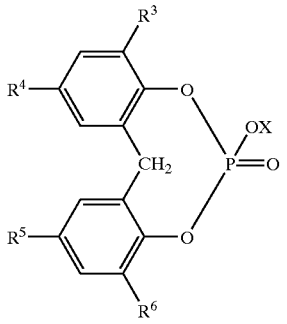

wherein each of $R^3$ to $R^6$ is independently an alkyl group, and X is a hydrogen atom, an ammonium group or a metal atom.

2. The thermal recording material of claim 1, wherein the thermal recording layer contains a benzotriazole derivative.

3. The thermal recording material of claim 2, wherein the benzotriazole derivative is a benzotriazole derivative dimer of the general formula (III), (III)

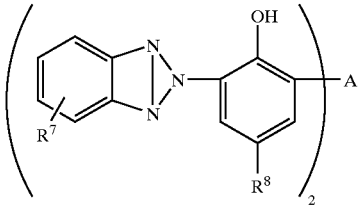

wherein $R^7$ is a hydrogen atom, an alkyl group, an alkoxyl group, an aryl group, an aryloxy group or a halogen atom, $R^8$ is an alkyl group having 1 to 18 carbon atoms, and A is an alkylidene group having 1 to 8 carbon atoms.

4. The thermal recording material of claim 1, wherein the dye precursor is 3-(N-ethyl-N-tolyl)amino-6-methyl-7-anilinofluorane.

5. The thermal recording material of claim 1, wherein the electron-accepting compound of the general formula (I) is N-(p-toluenesulfonyl)-N'-(3-p-toluenesulfonyloxyphenyl) urea.

6. The thermal recording material of claim 1, wherein the compound of the general formula (II) is 2,2'-methylenebis (4,6-di-tert-butylphenyl)phosphate or an ammonium, sodium or potassium salt thereof.

7. The thermal recording material of claim 6, wherein the compound of the general formula (II) is a sodium salt of 2,2'-methylenebis(4,6-di-tert-butylphenyl)phosphate.

8. The thermal recording material of claim 1, wherein the thermal recording layer contains a heat-fusible substance.

9. The thermal recording material of claim 1, which has an undercoat layer containing a pigment or a resin between a substrate and the thermal recording layer.

10. The thermal recording material of claim 9, wherein the undercoat layer contains, as a pigment, at least one member selected from an organic pigment having a through hole, organic hollow particles having an opening portion or organic hollow particles substantially having no opening portion.

11. The thermal recording material of claim 1, which has a protective layer formed on the thermal recording layer.

12. A thermal recording material comprising a substrate, an undercoat layer that contains a pigment and an adhesive as main components and is formed on the substrate, and a thermal recording layer that is formed on the undercoat layer and contains an electron-donating dye precursor and an electron-accepting compound that reacts with said dye precursor upon heating to cause said dye precursor to develop a color, said thermal recording layer comprising an electron-accepting compound of the general formula (I), (I)

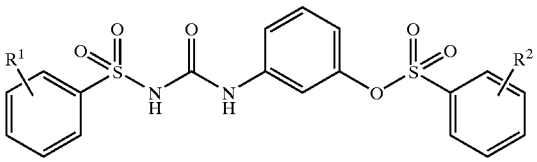

wherein each of $R^1$ and $R^2$ is independently a hydrogen atom or an alkyl group, and said undercoat layer comprising, as a pigment, at least one member selected from an organic pigment having a through hole, organic hollow particles having an opening portion each, or organic hollow particles substantially having no opening portion.

13. The thermal recording material of claim 12, wherein the thermal recording layer contains a compound of the general formula (II), (II)

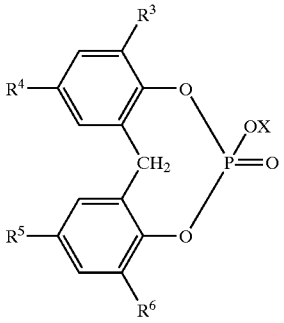

wherein each of $R^3$ to $R^6$ is independently an alkyl group, and X is a hydrogen atom, an ammonium group or a metal atom.

14. The thermal recording material of claim 13, wherein the compound of the general formula (II) is 2,2'-methylenebis(4,6-di-tert-butylphenyl)phosphate or an ammonium, sodium or potassium salt thereof.

15. The thermal recording material of claim 14, wherein the compound of the general formula (II) is a sodium salt of 2,2'-methylenebis(4,6-di-tert-butylphenyl)phosphate.

16. The thermal recording material of claim 12, wherein the thermal recording layer contains a benzotriazole derivative.

17. The thermal recording material of claim 16, wherein the benzotriazole derivative is a benzotriazole derivative dimer of the general formula (III), (III)

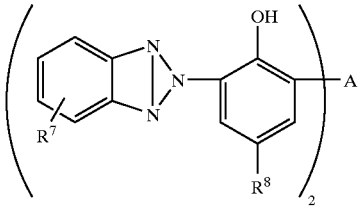

wherein R7 is a hydrogen atom, an alkyl group, an alkoxyl group, an aryl group, an aryloxy group or a halogen atom, $R^8$ is an alkyl group having 1 to 18 carbon atoms, and A is an alkylidene group having 1 to 8 carbon atoms.

18. The thermal recording material of claim 12, wherein the dye precursor is 3-(N-ethyl-N-tolyl)amino-6-methyl-7-anilinofluorane.

19. The thermal recording material of claim 12, wherein the electron-accepting compound of the general formula (I) is N-(p-toluenesulfonyl)-N'-(3-p-toluenesulfonyloxyphenyl) urea.

20. The thermal recording material of claim 12, wherein the thermal recording layer contains a heat-fusible substance.

21. The thermal recording material of claim 12, which has a protective layer formed on the thermal recording layer.

* * * * *